US006224203B1

(12) United States Patent
Wotton et al.

(10) Patent No.: US 6,224,203 B1
(45) Date of Patent: May 1, 2001

(54) HARD COPY PRINT MEDIA PATH FOR REDUCING COCKLE

(75) Inventors: Geoff Wotton, Battleground; Steve O. Rasmussen, Vancouver, both of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/312,372

(22) Filed: May 13, 1999

(51) Int. Cl.[7] ..... B41J 2/01
(52) U.S. Cl. ..... 347/101; 347/102; 347/104
(58) Field of Search ..... 347/101, 102, 347/104; 400/605, 648, 662

(56) References Cited

U.S. PATENT DOCUMENTS

| | | | | |
|---|---|---|---|---|
| D. 358,417 | | 5/1995 | Medin et al. | D18/56 |
| 3,592,334 | * | 7/1971 | Fleischauer | 198/184 |
| 4,237,466 | | 12/1980 | Scranton | 346/75 |
| 4,294,540 | | 10/1981 | Thettu | 355/76 |
| 4,792,249 | | 12/1988 | Lahr | 400/578 |
| 4,878,071 | | 10/1989 | Bibl et al. | 346/153.1 |
| 4,921,240 | | 5/1990 | Watson | 271/245 |
| 4,926,199 | | 5/1990 | Bibl et al. | 346/157 |
| 4,952,950 | | 8/1990 | Bibl et al. | 346/157 |
| 4,982,207 | | 1/1991 | Tunmore et al. | 346/138 |
| 5,031,002 | * | 7/1991 | Yaguchi | 355/312 |
| 5,037,079 | | 8/1991 | Siegel et al. | 271/3 |
| 5,124,728 | | 6/1992 | Denda | 346/134 |
| 5,197,812 | | 3/1993 | Worley et al. | 400/635 |
| 5,287,123 | | 2/1994 | Medin et al. | 346/140 |
| 5,294,965 | | 3/1994 | May | 355/312 |
| 5,329,295 | | 7/1994 | Medin et al. | 346/25 |
| 5,399,039 | | 3/1995 | Giles et al. | 400/636 |
| 5,406,321 | | 4/1995 | Schwiebert et al. | 347/102 |
| 5,420,621 | | 5/1995 | Richtsmeier et al. | 347/104 |
| 5,428,384 | | 6/1995 | Richtsmeier et al. | 347/102 |
| 5,461,408 | | 10/1995 | Giles et al. | 347/102 |
| 5,467,119 | | 11/1995 | Richtsmeier et al. | 347/102 |
| 5,479,585 | | 12/1995 | Komagine | 395/103 |
| 5,510,822 | | 4/1996 | Vincent et al. | 347/102 |
| 5,608,511 | | 3/1997 | Attridge | 399/398 |
| 5,631,685 | * | 5/1997 | Gooray et al. | 347/102 |
| 5,668,584 | | 9/1997 | Broder et al. | 347/102 |
| 5,717,446 | | 2/1998 | Teumer et al. | 347/35 |
| 5,754,208 | * | 5/1998 | Szlucha | 347/102 |
| 5,757,407 | * | 5/1998 | Rezanka | 347/102 |
| 5,992,994 | * | 11/1999 | Rasmussen et al. | 347/104 |

FOREIGN PATENT DOCUMENTS

| | | |
|---|---|---|
| 0294793A2 | 12/1988 | (EP) . |
| 0294793A3 | 12/1988 | (EP) . |
| 1222982 | 9/1989 | (JP) . |
| 2063878 | 3/1990 | (JP) . |
| 5318857 | 12/1993 | (JP) . |

* cited by examiner

*Primary Examiner*—John S. Hilten
*Assistant Examiner*—Minh H. Chau

(57) ABSTRACT

A wet-dye hard copy apparatus is provided with a vacuum transport for moving print media from and input, through a print zone, to an output. In order to reduce paper cockle, the print media is subjected to a post-printing predetermined bending while the print dye thereon is drying. In an alternative embodiment, a post-ejection bending heating step is added prior to ejecting a printed print medium to the apparatus output.

14 Claims, 4 Drawing Sheets

HARD COPY PRINT MEDIA PATH FOR REDUCING COCKLE

BACKGROUND OF THE INVENTION

1. Field of the Invention

The present invention relates generally to hard copy apparatus, more particularly to transport methods and devices for moving print media through a hard copy apparatus, and more specifically to a vacuum holddown print media path transport for wet-dye printing which reduces print media cockle.

2. Description of Related Art

Wet-dye hard copy apparatus, such as computer printers, graphics plotters, copiers, and facsimile machines, and the like, must contend with a major problem in that wet-dye saturated print media tends to deform. [For simplification is of discussion, the term "printer" is used hereinafter generically to mean all hard copy apparatus; the term "paper" is used generically hereinafter for all forms of print media. No limitation on the scope of the invention is intended by the inventors, nor should any such limitation be implied.] Wet-dye saturated paper becomes unacceptably wavy, or "cockled," as the dye interacts with the fibers of the paper. Moreover, particularly noticeable in color printing is the tendency of adjacent wet-dye areas to run or bleed into one another.

Commercial ink-jet products such as the Hewlett-Packard™ DeskJet™ computer printers employ a wet-dye inkjet technology for producing hard copy. The art of inkjet technology is relatively well developed. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions; incorporated herein by reference. Ink-jet devices are also described by W. J. Lloyd and H. T. Taub in *Output Hardcopy* [*sic*] *Devices*, chapter 13 (Ed. R. C. Durbeck and S. Sherr, Academic Press, San Diego, 1988). [Note that the term "ink" is used hereinafter also to refer to all liquid wet-dye systems, e.g., whether the apparatus is using ink (where water-based, dye-based or pigment-based), wet toner, or another liquid colorant. No limitation on the scope of the invention is intended by the inventors, nor should any such limitation be implied.]

Typically thermal ink-jet apparatus inks are water-based and when deposited on wood-based papers, they are absorbed into the cellulose fibers, causing the fibers to swell. As the cellulose fibers swell, they generate localized expansions, causing the paper cockle. Not only does this create a finished hard copy product that may be objectionable to the end-user, cockle growth can cause actual degradation of ink dot printing quality itself due to uncontrolled pen-to-paper spacing which may even, in turn, lead to pen printhead-to-paper contact as the cockle waves move a region of the paper upwardly.

Moreover, most commercial ink-jet printers allow the paper to exit the printing zone on a flat platen or into a substantially flat output tray while the ink is drying. A flat platen with no post-printing holddown mechanism allows cockle to expand, generally creating larger waves in the sheet of paper.

Furthermore, in order to produce high quality color copy, e.g., photo-quality printing, ink flux is increased to produce vivid color saturation. This flux increase further exacerbates the paper cockle problem.

Still further, ink-jet printhead size is increasing to increase throughput. As the print zone length increases, ink bleed effects and the paper cockle problem are again enlarged or intensified.

Several solutions to these problems have been developed. U.S. Pat. No. 4,329,295 (Medin et al.) for a Print Zone Heater Screen for Thermal Ink-Jet Printer, U.S. Pat. No.

5,461,408 (Giles et al. ) for a Dual Feed Paper Path for Ink-Jet Printer, U.S. Pat. No. 5,399,039 (Giles et al.) for an Ink-Jet Printer with Precise Print Zone Media Control, U.S. Pat. No. 5,420,621 (Richtsmeier et al.) for a Double Star Wheel for Post-Printing Media Control in Inkjet Printing, and Des. Pat. No. 358,417 (Medin et al.) (each is assigned to the common assignee of the present invention and incorporated herein by reference) exemplify various techniques for a hard copy apparatus using conventional electromechanical paper feed systems.

There remains a need for print zone and post-print zone paper path transport mechanisms that assist in reducing the expanding paper cockle problem. One solution is to hold the paper with a vacuum force. However, another problem has become evident as attempts have been made to employ vacuum forces for holding paper in wet printing environments. For example, with a drum surface employing a field of discrete vacuum holes, the localized vacuum pressure against regions of the underside of the paper adjacent the vacuum holes draws the wet dye through the capillaries of the paper material before the dye has time to set. This results in alternating dark and light concentrations of dye in the final image correlating to the individual vacuum force influence regions of the holes in the field. Again, the non-uniform saturation leads to paper cockle deformation of the paper as the ink dries. It has been found that vacuum holding also reduces the wavelength of the free-growing cockle and creates a higher frequency, or "sharper" looking, cockle wave in the paper.

Therefore, there is a need for vacuum holddown paper path systems that assist in reducing or substantially eliminating paper cockle.

SUMMARY OF THE INVENTION

In its basic aspects, the present invention provides a method for reducing cockle of print media in a wet dye hard copy apparatus having a vacuum platen. The method includes the steps of: transporting the media along a paper path to a print zone of the apparatus superjacent the vacuum platen; transporting the media along a continuing paper path through the print zone while printing on at least a first downstream region of the media within the print zone; and substantially immediately following printing on the downstream region of the media, bending the downstream region having wet print thereon along at least one predetermined radius of curvature for reducing cockle of the print media.

In another basic aspect, the present invention provides a wet-dye hard copy apparatus including: printing means for depositing wet-dye on a print medium in a print zone of the apparatus; vacuum platen means for maintaining the print medium in the print zone in a substantially planar predetermined orientation to the printing means; and transport means for moving the print medium through a paper path from an input side ff the platen means through the print zone to an output side, the paper path including means for inducing a cockle-reducing curvature of print medium regions having wet dye thereon.

In another basic aspect, the present invention provides an ink-jet print media transport device including: a vacuum transport for moving print media sequentially through a paper path including a platen therein having an input side, a print zone, and to an output side; and the transport including mechanisms downstream of the print zone for inducing a cockle-reducing curvature of print medium regions having wet dye thereon.

In another basic aspect, the present invention provides a method for reducing cockle waves in an ink-jet hard copy apparatus, including the steps of: moving a wet sheet of printed paper along a post-printing zone curvilinear paper path such that wet ink on the sheet is kept from contact with any surface while bending the sheet through predetermined radii of curvature to stretch the paper and reduce cockle waves; and following bending the sheet through the predetermined radii of curvature, heating the printed paper to press any remaining cockle into a substantially planar configuration.

It is an advantage of the present invention that it reduces the amplitude of cockle waves.

It is an advantage of the present invention that by substantially eliminating cockle, a higher quality print is provided.

It is an advantage of the present invention that it permits the post-printing use of a post-printing dryer, i.e., a heater mechanism to fuse the paper fibers and ink rapidly, further reducing or eliminating cockle.

It is another advantage of the present invention that the paper path reduces wet paper cockle wave amplitude such that subsequent paper path smoothing techniques do not cause wrinkles.

Other objects, features and advantages of the present invention will become apparent upon consideration of the following explanation and the accompanying drawings, in which like reference designations represent like features throughout the drawings.

Figure 1:
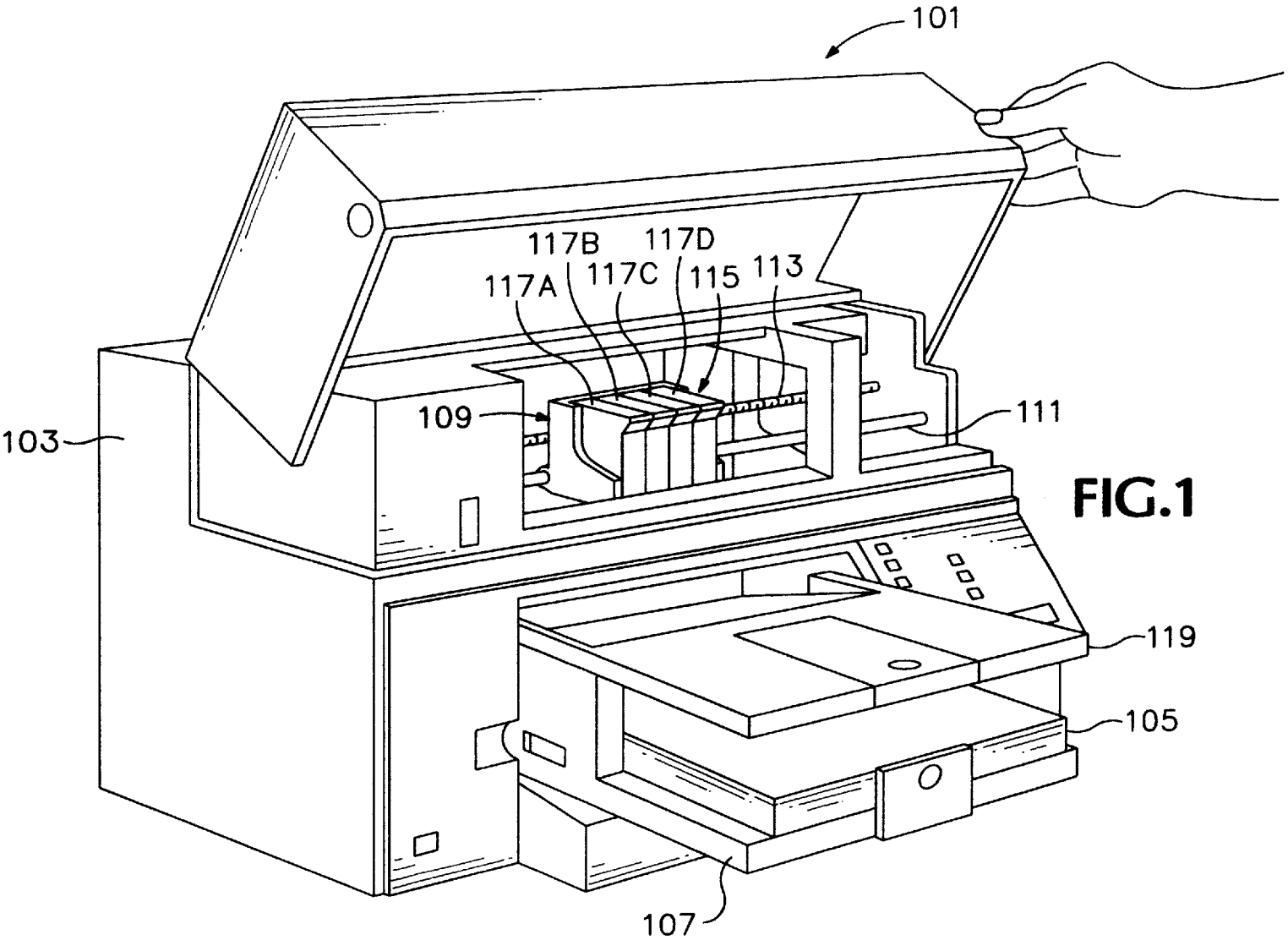
FIG. 1 (PRIOR ART) is a schematic drawing in perspective view of an ink-jet printer.

The drawings referred to in this specification should be understood as not being drawn to scale except if specifically noted.

DESCRIPTION OF THE PREFERRED EMBODIMENT

Reference is made now in detail to a specific embodiment of the present invention which illustrates the best mode presently contemplated by the inventors for practicing the invention. Alternative embodiments are also briefly described as applicable. While for convenience of explanation the present invention is described with respect to a thermal ink-jet exemplary embodiment, it will be recognized by a person skilled in the art that the methodology can be applied in any wet-dye hard copy apparatus. Thus, no limitation on the scope of the invention is intended by use of this example and none should be implied therefrom FIG. 1 (PRIOR ART) depicts an ink-jet hard copy apparatus, in this exemplary embodiment, a computer peripheral, color printer, 101. A housing 103 encloses the electrical and mechanical operating mechanisms of the printer 101. Operation is administrated by an electronic controller (usually a microprocessor or application specific integrated circuit ("ASIC") controlled printed circuit board, not shown) connected by appropriate cabling to the computer (not shown). It is well known to program and execute imaging, printing, print media handling, control functions, and logic with firmware or software instructions for conventional or general purpose microprocessors or ASIC's. Cut-sheet print media 105, loaded by the end-user onto an input tray 107, is picked by a conventional paper-path pick mechanism (not shown) and delivered to a paper transport mechanism, as described hereinafter with respect to FIGS. 2 and 3, to an internal printing station, also referred to as the "print zone," where graphical images or alphanumeric text are created using state of the art color imaging and text rendering using dot matrix manipulation techniques. A carriage 109, mounted on a slider 111, scans the print medium. An encoder strip 113 and appurtenant devices are provided for keeping track of the position of the carriage 109 at any given time. A set 115 of individual ink-jet pens, or print cartridges 117A—117D are releasably mounted in the carriage 109 for easy access and replacement (generally, in a full color system, inks for the subtractive primary colors, cyan, yellow, magenta (CYM) and true black (K) are provided). Each pen or cartridge has one or more printhead mechanisms (not seen in this perspective) for "jetting" minute droplets of ink to form dots on adjacently positioned print media. Once a printed page is completed, the print medium is ejected onto an output tray 119. Generally, the pen scanning axis is referred to as the x-axis, the print media transport axis is referred to as the y-axis, and the ink drop firing direction is referred to as the z-axis.

Figure 2:
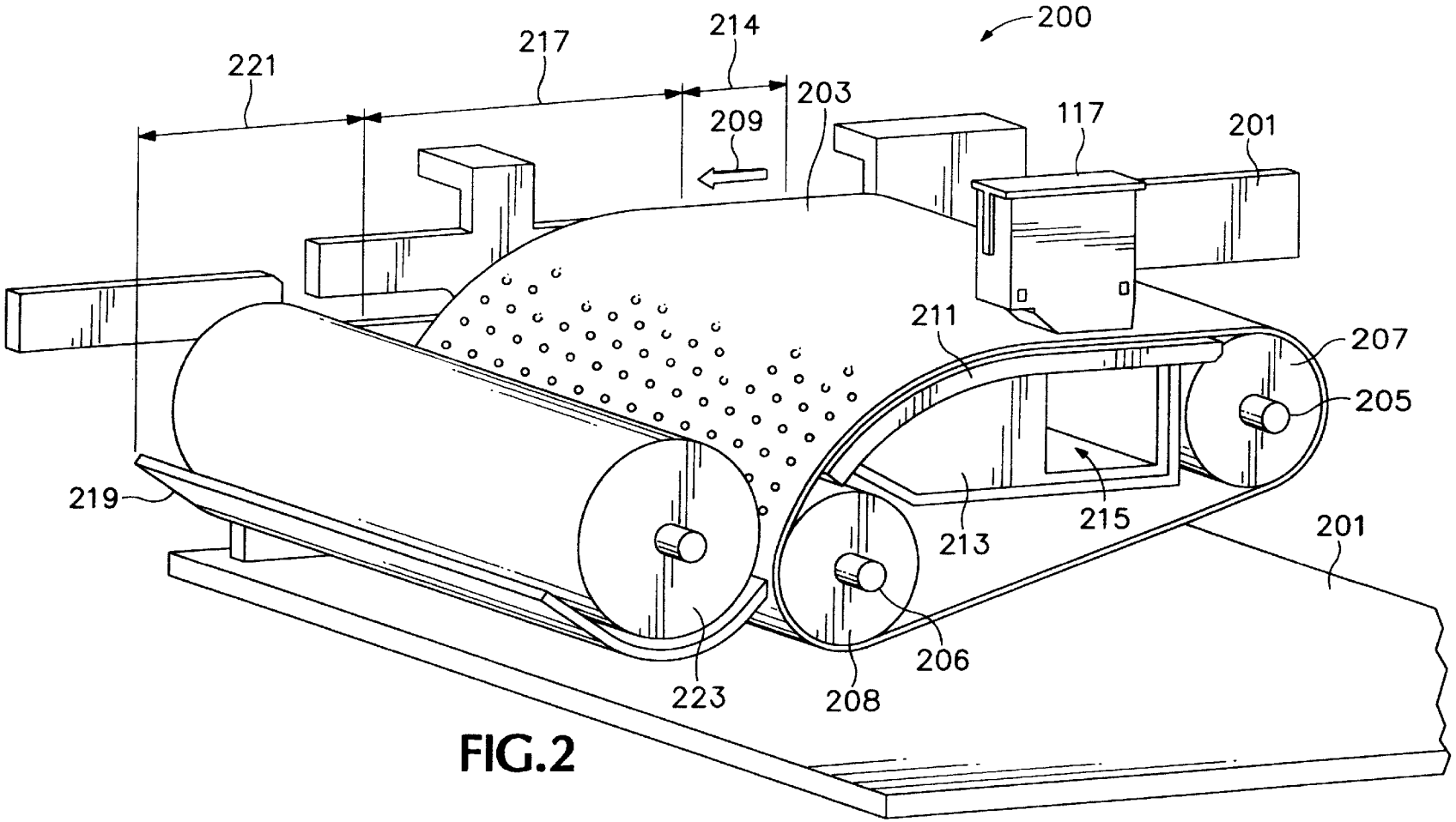
FIG. 2 is a schematic drawing in a perspective view of a wet-dye printer paper transport in accordance with the present invention.
Figure 3:
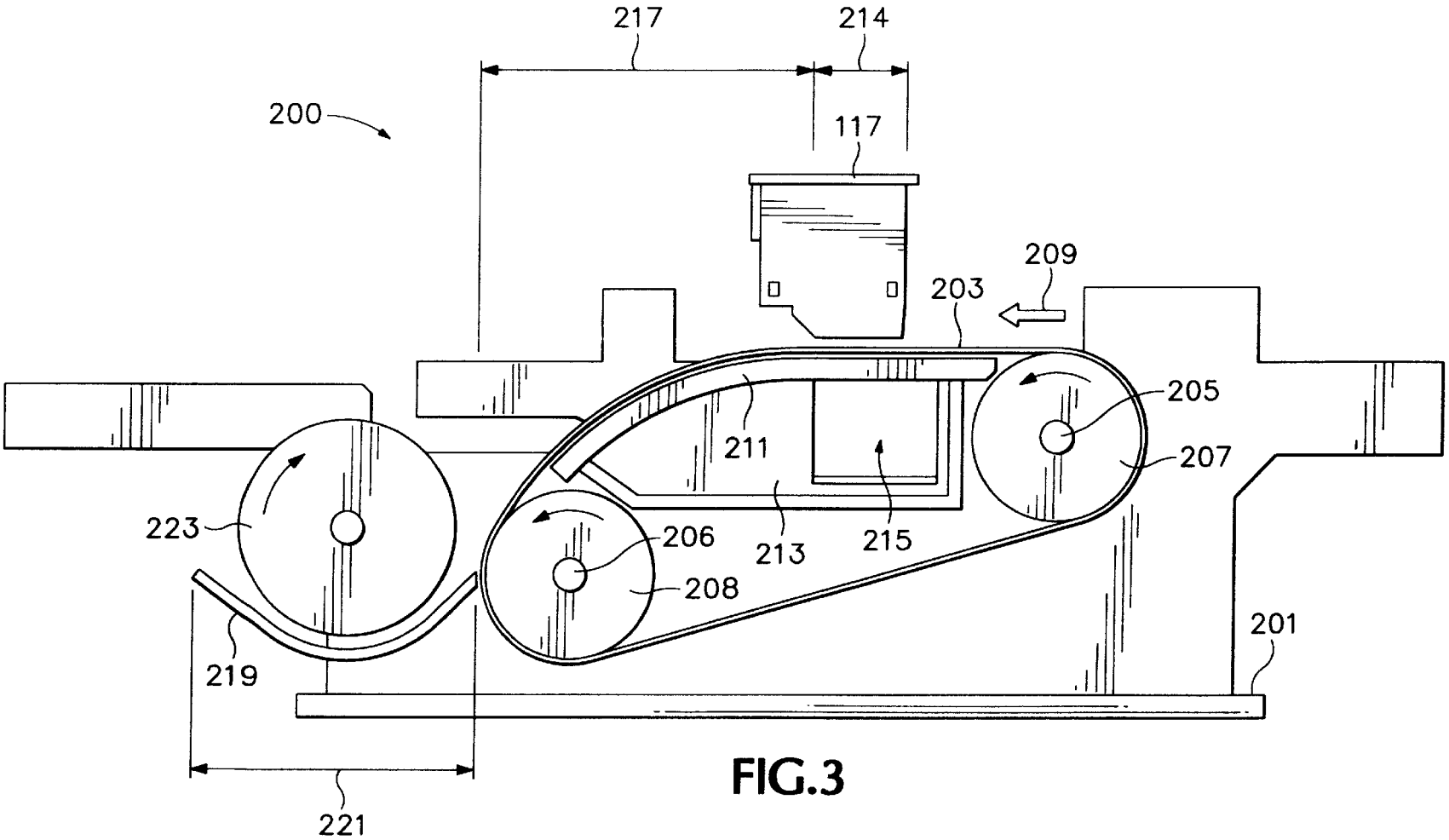
FIG. 3 is an elevation view of the depiction of the present invention as shown in FIG. 1.

FIGS. 2 and 3 show the essential elements of an ink-jet printer paper path transport 200 in accordance with the present invention. A molded or stamped chassis 201 suitable for a specific implementation is provided as a framework. A vacuum belt 203 rides on a pair of axle 205, 206 mounted belt drive rollers 207, 208, respectively. At least one of the belt drive rollers 207, 208 is conventionally driven to provide circulating motion of the belt 203 as depicted by arrow 209. The vacuum belt 203 has an outer surface including vacuum ports for exerting a suction force across the belt as would be known in the art.

A vacuum platen 211 in a print zone 214 beneath the scanning pen 117 printhead is mounted atop a vacuum box 213 wherein a vacuum is created in a vacuum box chamber 215 by any suitable conventional means, such as an exhaust fan (not shown). The vacuum force is thus exerted through the platen 211 and belt 203.

While a person skilled in the art will recognized that there are many variables to be considered, as mentioned in the Background section, supra, generally, the use of a vacuum holddown tends to reduce the wavelength of the free growing cockle, creating a more noticeable cockle wave. This "sharper" cockle tends to be more visible to the eye than free-growing cockle. Furthermore, vacuum holddown systems have been found to have an inverse relation ship between power and cockle effects. In other words, as the power to the vacuum holddown is increase, the paper is less likely to move as the cockling occurs. Large cockle waves that form first are pulled toward the holddown surface and forced into smaller waves and possibly even wrinkles. Bending the paper while the ink is still wet has been found to reduce these effects.

The vacuum platen 211 is provided with a bent holddown region 217 such that the belt 203, conforming to the subjacent surface of the platen as the belt circulates 209, is similarly bent. Therefore, referring briefly to FIG. 1, a sheet of paper 105, having been picked from the input tray 107 and delivered to the vacuum belt 203 on the input side of the print zone 214 (in FIG. 2 from the perspective rear; in FIG. 3 from the right), has its leading edge captured and adhered to the belt by the vacuum force at the upstream extremity, or entrance, of the platen 211. Starting with the leading edge of the paper, the sheet progresses through the print zone 214 as the belt 203 circulates 209 and approximately at the start of the exit of the print zone begins to bend in conformance to the belt and platen bent holddown region 217. Ink is applied in the z-axis by scanning the pen 117 back and forth in the x-axis across the paper adhered to the belt 203 by the vacuum flow such that the wet side of the page is in contact with only the ambient atmosphere.

The substantially immediate, post-printing, bending of the still wet paper has been found to force the cockle into a higher frequency; that is, the waves are forced into a smaller amplitude, lower wavelength form; i.e., large waves become a number of small waves and small waves are reduced to essentially flat paper. It has been found that bending the sheet, print side up, first along a convex radius of curvature (i.e., with the printed side bending and slightly stretching outwardly) in the range of approximately 50-to-90 mm provides the desired effect and provides a commercially feasible design. Paper thickness will affect the selection of optimum initial bending radius.

Returning now to FIGS. 2 and 3, a secondary post print zone bending of the sheet further reduces the amplitude of the cockle waves, increasing the frequency. A bender plate 219 is provided to recurve the printed paper in a second bending region 221 down stream of the first bending region 217 for reducing cockle while the ink is still drying. Cockle growth is moisture dependent. As cockle growth subsides, the downstream bender plate 219 radius of curvature is less critical. Generally, the bender plate 219 is adapted to provide the desired recurve and to deliver the sheet to the apparatus output tray (FIG. 1, tray 119). For the implementation shown, it has been found that a concave radius of curvature in the range of approximately 20-to-30 mm is acceptable. A guide roller 223 separated from the bender plate 219 has a surface that ensures the exiting sheet remains aligned in the paper path. While the wet paper will conform to the concave radius of bending plate 219, the guide roller 223 should rotate at the same speed that the sheet is being transported such that any incidental contact with the wet surface of the sheet does not result in a smearing of the ink.

In essence, the post-printing paper path is curvilinear such that wet ink is kept from contact with any surface while bending the sheet to stretch the paper and reduce the amplitude of or eliminate any cockle waves. It will be recognized that the type of print media printed on, the Ad selected vacuum force and radii for bending, need to be balanced in accordance with any specific implementation.

Figure 4:
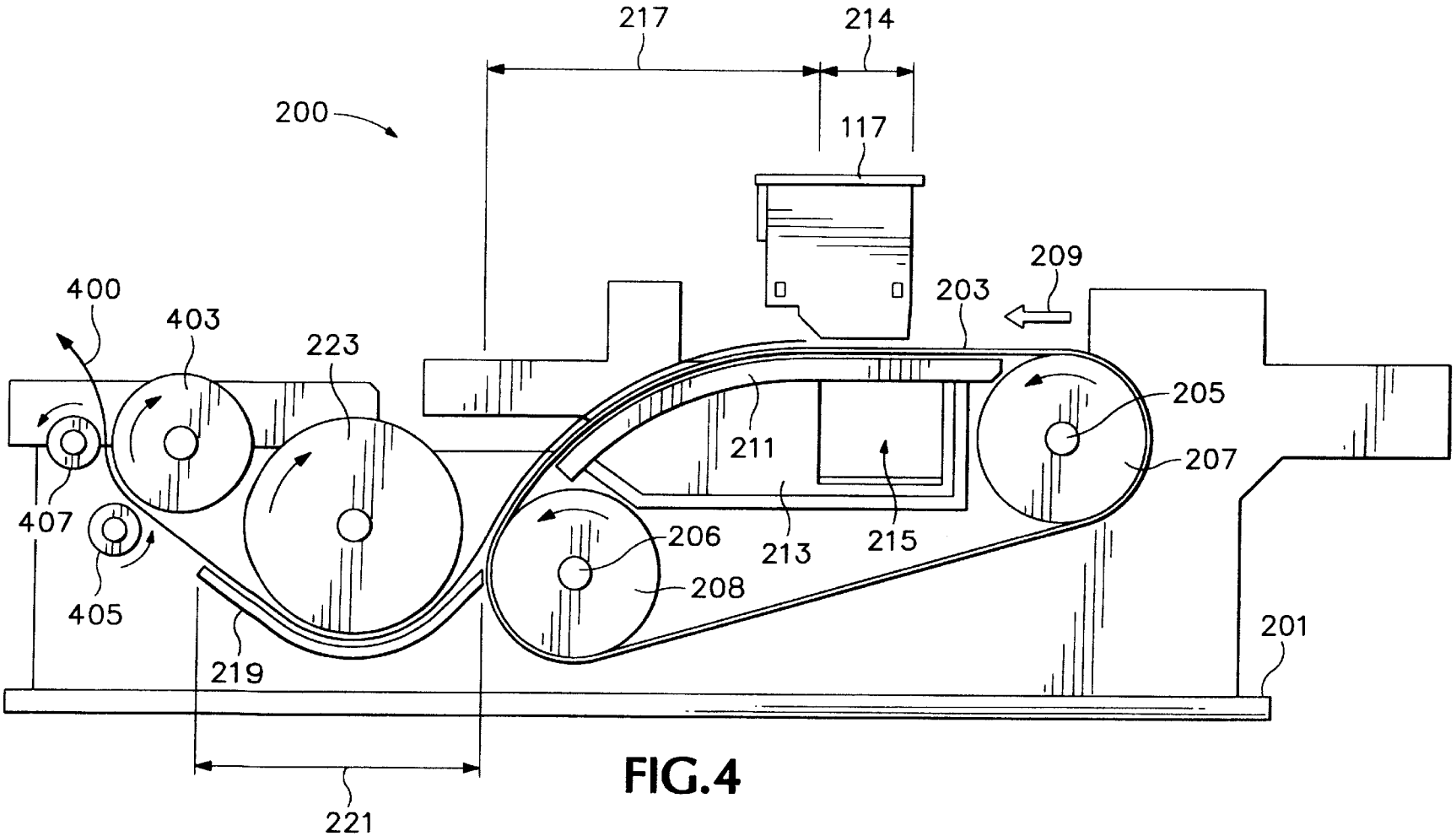
FIG. 4 is an elevation view of the depiction of the present invention as shown in FIG. 3 further including a post-printing paper path press.

Turning to FIG. 4, a post-printing press 401 is provided in an alternative embodiment. The media path 400 includes a heated roller 403. An exiting sheet of printed media is pinched between the heated roller 403 and two pressure rollers 405, 407, with the wet print side facing the heated roller 403.

Post-printing heating in the paper path 400 ensures that cockle waves will not return if the paper is still slightly wet as it exits the initial bending from the vacuum belt platen 211 and the post-platen bending plate 219.

Once the trailing edge of a sheet of paper, now a completely printed page, is released from the paper path 400, a known manner paper ejection transport (not shown) is engaged with the sheet to deliver the sheet to the printer output (see FIG. 1, tray 119), completing the paper path.

While the present invention shows mechanical bending (see elements 217, 219), it will be recognized by a person skilled in the art that other mechanisms, such as forced air pressure, a secondary vacuum transport belt, an arrangement of star-wheels, or the like, also can be employed within the scope of the invention. This would eliminate any contact with the printed side of the paper—other than as demonstrated in FIG. 4—through ejection into an output tray and allow an increased throughput.

While a recirculating vacuum belt system has been used in the exemplary embodiment, it will be recognized by a person skilled in the art that a variety of alternate implementations may be employed within the scope of the invention. For example, in a dual feed paper path such as shown by Giles et al. '408, but using a reciprocating vacuum belt could be employed.

A person skilled in the art will recognize that in another implementation of the transport device, a series of vacuum holddown rollers having a predetermined radius of curvature can be substituted for the bent region 217 of the platen and the bender plate 219.

While horizontal input and output tray system has been demonstrated, the present invention can be conformed to a substantially vertical input and output tray system.

The present invention provides a vacuum transport paper path in which printed media is bended while the ink is still drying. This substantially eliminates cockle waves or reduces the amplitude of the cockle waves to an extent that the waves become less visible, providing an overall improved print quality. The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. For example, an implementation for a non-vacuum platen system may be derived. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. A method for reducing cockle of print media in a wet dye hard copy apparatus having a vacuum platen, comprising the steps of:

transporting the media along a paper path to a print zone of the apparatus superjacent the vacuum platen;

transporting the media along a continuing paper path through the print zone while printing on at least a first downstream region of the media in the print zone;

substantially immediately following printing on the downstream region of the media, bending the downstream region having wet print thereon along at least one predetermined radius of curvature for reducing cockle of the print media by bending the media having wet dye thereon along a predetermined first radius of curvature such that cockle amplitude is reduced, and following the step of bending the media, rebending the media having wet dye thereon along a second radius of curvature until the wet dye is substantially dry.

2. The method as set forth in claim 1, comprising the step of:

during bending of the downstream region, continuing transport of the media through the print zone and printing on an upstream region of the media.

3. The method as set forth in claim 1, the step of bending further comprises the step of:

bending the media such that wet dye print moves through a first radius of convex curvature having a range of 50 mm to 90 mm.

4. The method as set forth in claim 1, the step of rebending further comprises the step of:

recurving the media.

5. A wet-dye hard copy apparatus comprising:

printing means for depositing wet-dye on a print-side of a print medium in a print zone of the apparatus;

vacuum platen means for maintaining the print medium in the print zone in a substantially planar predetermined orientation to the printing means; and transport means for moving the print medium through a paper path from an input side of the platen means through the print zone to an output side of the platen means, the paper path including means for inducing a cockle-reducing curvature of print medium regions having wet dye thereon, wherein the transport means includes a vacuum belt holddown, the vacuum belt holddown having a bend region for bending the print medium substantially immediately following deposit of wet dye thereon, and downstream of the bend region of the paper path, a bending means for forgoing the print medium into a concave radius of curvature.

6. The apparatus as set forth in claim 5, comprising:

the bend region forces the print medium regions having wet dye thereon into a convex radius of curvature.

7. The apparatus as set forth in claim 6, comprising:

the convex radius of curvature having a range of approximately 50 mm to 90 mm.

8. The apparatus as set forth in claim 5, comprising:

the bending means including a plate for receiving the print medium and forcing the print medium along a continuation of the paper path, said bending means having a concave radius of curvature having a range of approximately 20 mm to 30 mm.

9. An ink-jet print media transport device comprising:

a vacuum transport for moving print media sequentially through a paper path including a platen therein having an input side, a print zone, and an output side; and the transport including mechanisms downstream of the print zone for inducing a cockle-reducing curvature of print medium regions having wet dye thereon, wherein the transport includes a vacuum belt holddown, the belt holddown having a bend region for bending the print medium substantially immediately following deposit of wet dye thereon at the print zone as the print media progresses through the paper path, and downstream of the bend region of the paper path, a bender device for forcing the print medium into a concave radius of curvature.

10. The device as set forth in claim 9, comprising:

the bend region forces the print medium regions having wet dye thereon into a convex radius of curvature.

11. The device as set forth in claim 10, comprising:

the convex radius of curvature having a range of approximately 50 mm to 90 mm.

12. The device asset forth in claim 9, comprising:

the bender device including a plate having a concave radius of curvature having a range of approximately 20 to 30 mm.

13. The device as set forth in claim 9, comprising:

in the paper path, following the bender device, a means for heating the print medium to press remaining cockle waves in the print medium to a substantially planar configuration.

14. A method for reducing cockle waves in a wet-dye ink-jet hard copy apparatus having a vacuum platen, comprising the steps of:

transporting a sheet of paper along a paper path to a printing zone of the apparatus superjacent the vacuum platen;

moving a wet sheet of printed paper along a post-printing zone curvilinear paper path such that wet ink on the sheet is kept from contact with any surface while bending the sheet through a first convex predetermined radius of curvature to reduce cockle waves; and following bending the sheet through the first predetermined radius of curvature, heating the printed paper to press any remaining cockle into a substantially planar configuration and recurving the paper through a concave radius.

* * * * *